US005924339A

United States Patent [19]

Huang

[11] Patent Number: 5,924,339

[45] Date of Patent: Jul. 20, 1999

[54] SCREWDRIVER

[76] Inventor: Chin-Tan Huang, No. 39, Lane 240, Li-Jen Road, Ta-Li City, Taichung Hsien, Taiwan

[21] Appl. No.: 09/033,954

[22] Filed: Mar. 3, 1998

[51] Int. Cl.[6] ..... B25B 17/00

[52] U.S. Cl. ..... 81/57.31; 81/57.3

[58] Field of Search ..... 81/57.3, 57.42, 81/62, 63.1, 57.18

[56] References Cited

U.S. PATENT DOCUMENTS 5,289,743 3/1994 Cirami ..... 81/57.31
5,406,866 4/1995 Badiali ..... 81/57.3

*Primary Examiner*—Timothy V. Eley
*Assistant Examiner*—Sinclair Skinner
*Attorney, Agent, or Firm*—Rosenberg, Klein & Bilker

[57] ABSTRACT

A screwdriver is disclosed. It includes a grip, a connecting stem, a receiving member, a transmission shaft and a rotary wheel. In general using state, a user can quickly tighten a screw. In the case that a great torque is necessary, the grip of the screwdriver is depressed to connect the connecting stem with the transmission shaft so as to obtain greater torque. When depressing the grip, the using state will be affected and the screwdriver can be used conveniently. The sleeves can be received in the chambers of the grip, while the screwdriver heads can be received in the receptacles of the receiving member. The cap member and stopper member are both transparent, permitting the user to observe the positions of the respective tools. Therefore, the user can easily quickly locate the necessary tools. Moreover, the tools are safely stored without possibility of missing.

8 Claims, 7 Drawing Sheets

SCREWDRIVER

BACKGROUND OF THE INVENTION

The present invention relates to a screwdriver which can be used in a more convenient and more quickly manner. The screw driver can also receive sleeves and screwdriver heads therein.

FIG. 8 shows a conventional screwdriver 84 for screwing a screw 81 into a thread hole 83 of a board body 82 or unscrewing the screw 81 out of the thread hole 83. The thread hole 83 can be divided into an outer and an inner sections 83A, 83B. Generally, the length of the outer section 83A occupies most of the total length of the thread hole 83. However, it is relatively strength-saving to screw in or unscrew out the screw 81 through this section. Reversely, although the length of the inner section 83B only occupies a small part of the total length of the thread hole 83, it is relatively laborious to screw in or unscrew out the screw 81 through this part. For example, when a user wants to screw the screw 81 into the thread hole 83, he needs to first gradually screw the screw 81 through the outer section 83A. While relatively strength-saving, it will be quite time-consuming to complete the procedure since each time the screwdriver 84 is rotated through a circle, the screw 81 is only rotated through one circle. Then the screw 81 needs to be screwed into the inner section 83B. This procedure is relatively laborious. Finally, the screw 81 is totally screwed in. Therefore, it is necessary to shorten the time for screwing the screw 81 through the outer section 83A of the thread hole 83.

SUMMARY OF THE INVENTION

It is therefore a primary object of the present invention to provide a screwdriver in which in general using state, a user can rotate a rotary wheel to rotarily drive a transmission shaft so as to quickly tighten a screw. In the case that a great torque is necessary, the grip of the screwdriver is depressed to connect the connecting stem with the transmission shaft so as to obtain greater torque. When depressing the grip, the using state will be affected and the screwdriver can be used conveniently.

It is a further object of the present invention to provide the above screwdriver in which the sleeves can be received in the chambers of the grip, while the screwdriver heads can be received in the receptacles of the receiving member. The cap member and stopper member are both transparent, permitting the user to observe the positions of the respective tools. Therefore, the user can easily quickly locate the necessary tools. Moreover, the tools are safely stored without possibility of missing.

The present invention can be best understood through the following description and accompanying drawings, wherein:

DETAILED DESCRIPTION OF THE PREFERRED EMBODIMENT

Figure 1:
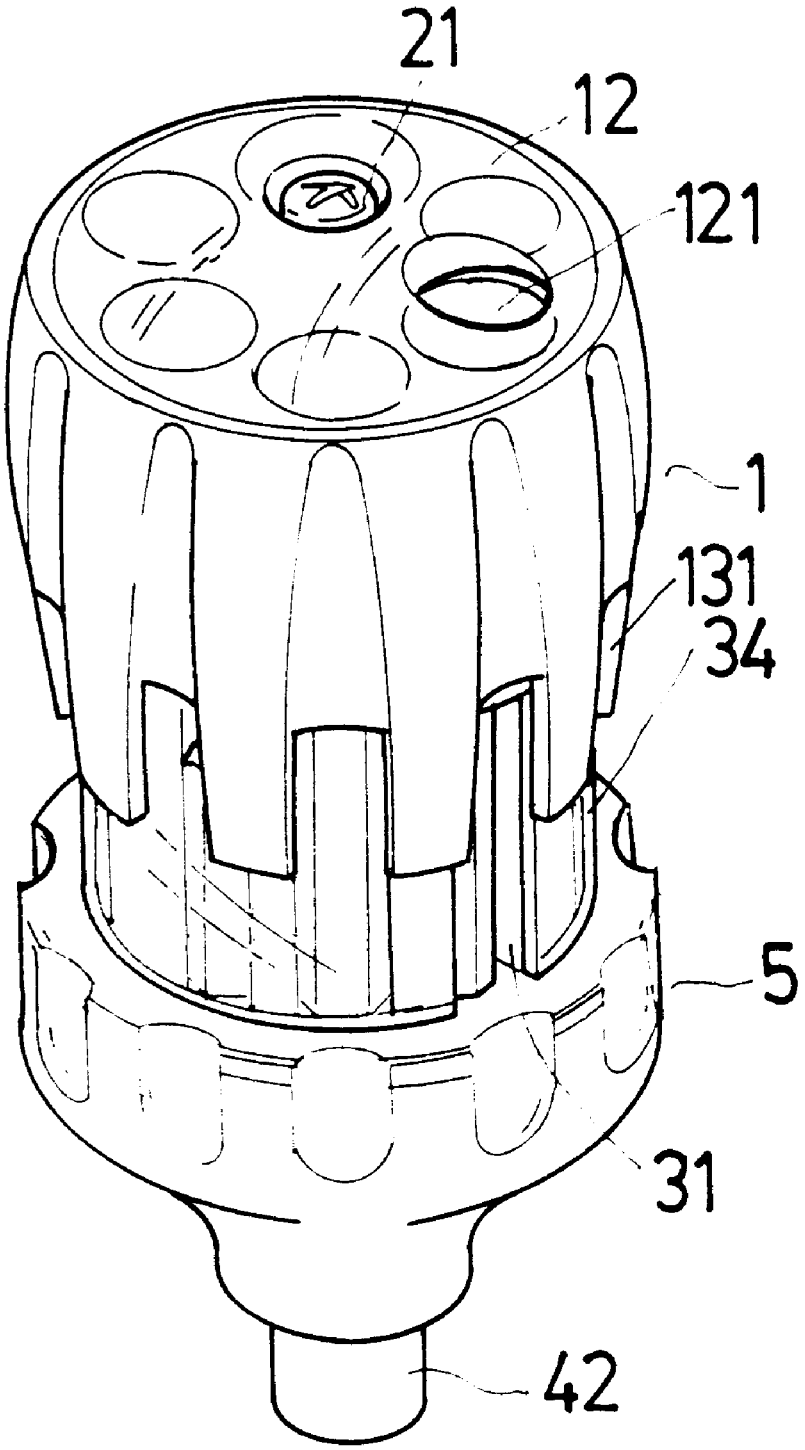
FIG. 1 is a perspective assembled view of the present invention.
Figure 2:
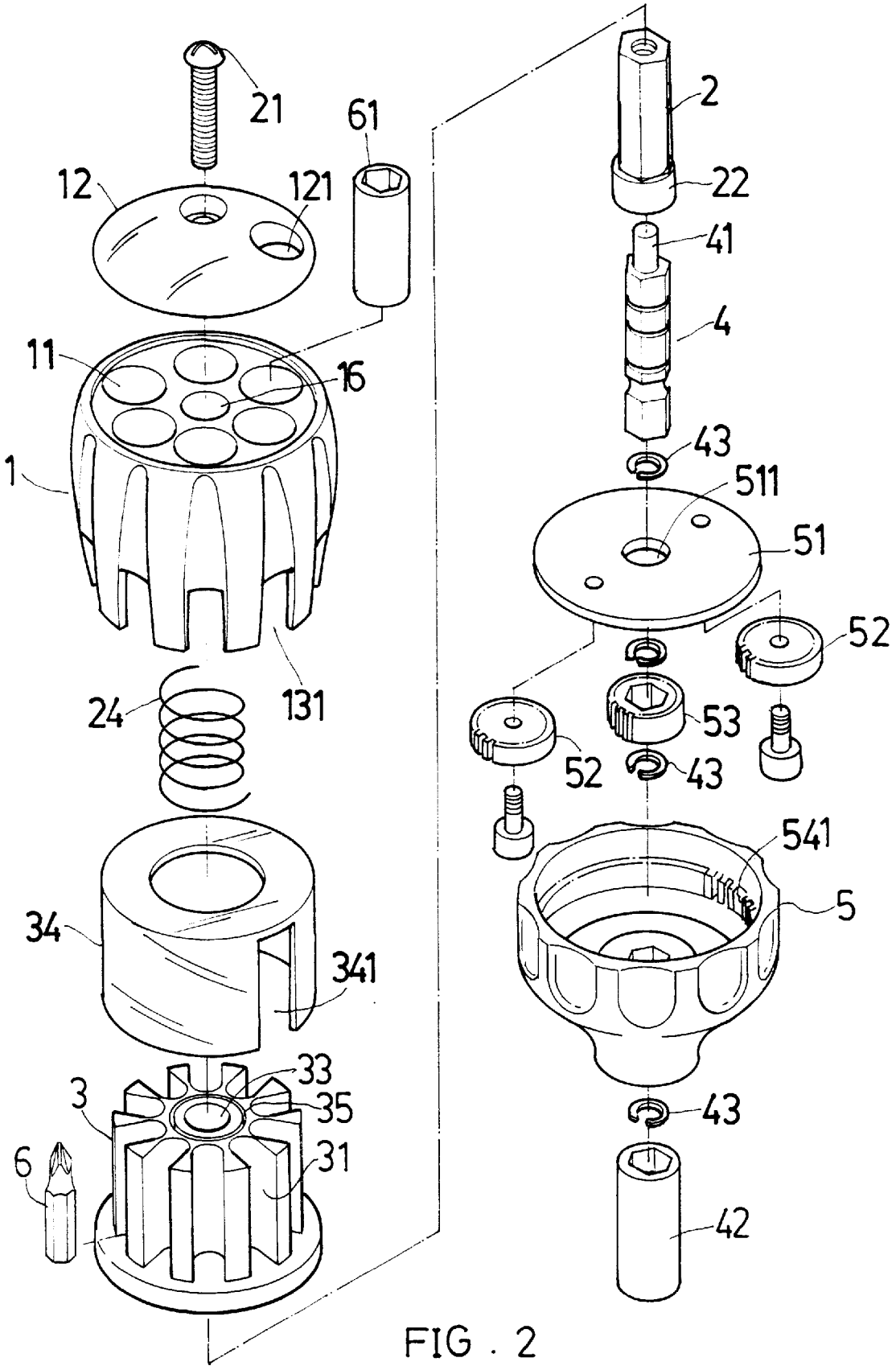
FIG. 2 is a perspective exploded view of the present invention.
Figure 3:
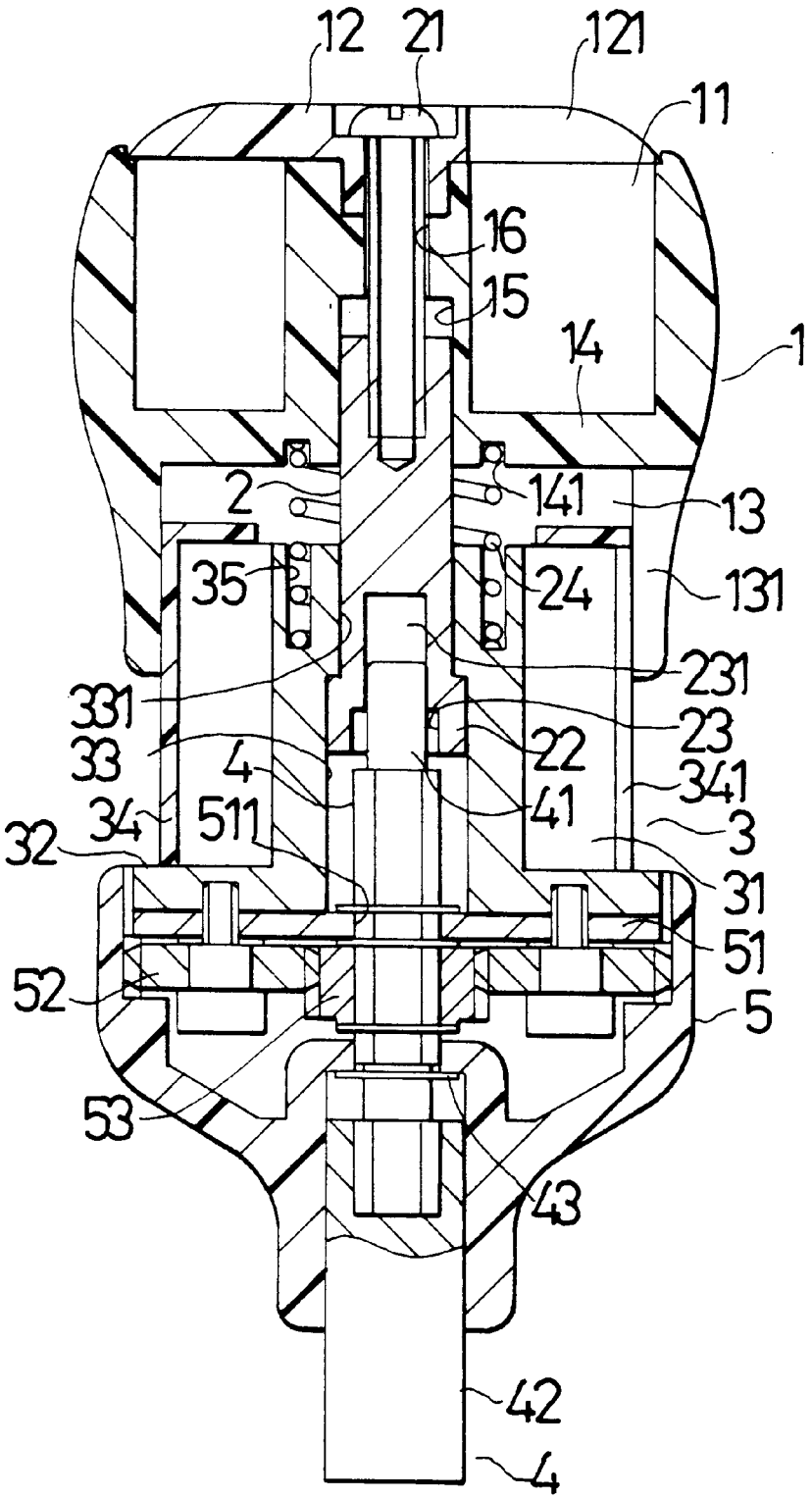
FIG. 3 is a sectional assembled view of the present invention.

Please refer to FIGS. 1 to 7. The present invention includes a grip 1, a connecting stem 2, a receiving member 3, a transmission shaft 4 and a rotary wheel 5.

The grip 1 is a substantially cylindrical body the top face of which is formed with multiple annularly arranged chambers 11. A transparent cap member 12 covers the chambers 11. One side of the cap member 12 is formed with a top through hole 121. The bottom of the grip 1 is formed with a fitting socket 13 coaxial with the grip 1. The wall of the fitting socket 13 is formed with multiple cut notches 131 extending to the bottom face of the grip 1. The fitting socket 13 is isolated from the chambers 11 by a diaphragm 14. The bottom face of the diaphragm 14 is formed with an annular insertion groove 141 coaxial with the grip 1. In addition, the lower section of the axis of the grip 1 has a hexagonal hole 15. The upper section of the axis of the grip 1 has a through hole 16 communicating with the hexagonal hole 15.

The connecting stem 2 has a hexagonal cross-section. The upper section of the connecting stem 2 is fitted in the hexagonal hole 15 of the grip 1. The top end of the connecting stem 2 is coupled with the cap member 12 by a screw 21. The bottom of the connecting stem 2 has an enlarged end 22 with a larger diameter. The bottom face of the enlarged end 22 is formed with a connecting hole 23 the upper section of which is a circular hole 231. In addition, a spring 24 is fitted around the connecting stem 2. The top end of the spring 24 is fitted in the annular groove 141.

The receiving member 3 is a substantially cylindrical body the upper section of which is fitted in the fitting socket 13 of the grip 1. The periphery of the receiving member 3 is formed with multiple axially extending receptacles 31 for placing screwdriver heads 6 therein. The top face of the receiving member 3 is further formed with a coaxial circular receiving groove 35 downward extending from the top face. The bottom end of the spring 24 is fitted in the circular groove 35. The bottom of the receiving member 3 is formed with a flange 32. The receiving member 3 is further formed with a coaxial through channel 33. The upper section of the through channel 33 is small diameter hexagonal hole 331. The enlarged end 22 of the connecting stem 2 is received in the through channel 33. In addition, a transparent cylindrical stopper member 34 is fitted around the receiving member 3. One side of the stopper member 34 is formed with an axial slot 341.

The transmission shaft 4 has a substantially hexagonal cross-section. The upper section thereof is a cylindrical section 41 for fitting into the circular hole 231 of the connecting stem 2. The middle section of the transmission shaft 4 is movably engaged in the connecting hole 23. In addition, the bottom end of the transmission shaft 4 is connected with a screwdriver connecting rod 42. Also, the transmission shaft 4 is latched by multiple latch rings 43.

The rotary wheel 5 is disposed at the bottom section of the receiving member 3, having a fixing plate 51 fixed with the receiving member 3. The fixing plate 51 is formed with a coaxial through aperture 511 smaller than the through channel 33 of the receiving member 3. Two opposite planet gears 52 are fixedly disposed on bottom face of the fixing plate 51. The inner sides of the planet gears 52 mesh with a sun gear 53 fixed on the transmission shaft 4. In addition, the outer sides of the planet gears 52 mesh with internal teeth 541 of the rotary wheel 5. The bottom end of the rotary wheel 5 sleeves the screwdriver connecting rod 42. The rotary wheel 5 and the transmission shaft 4 are restricted by each other via a latch ring 43.

Figure 4:
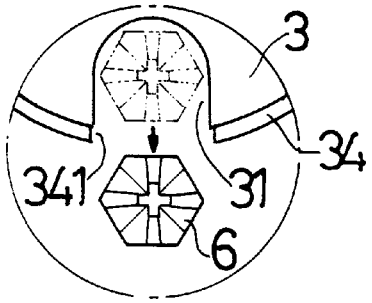
FIG. 4 shows that the screwdriver head is dropped out of the receptacle of the receiving member of the present invention.
Figure 5:
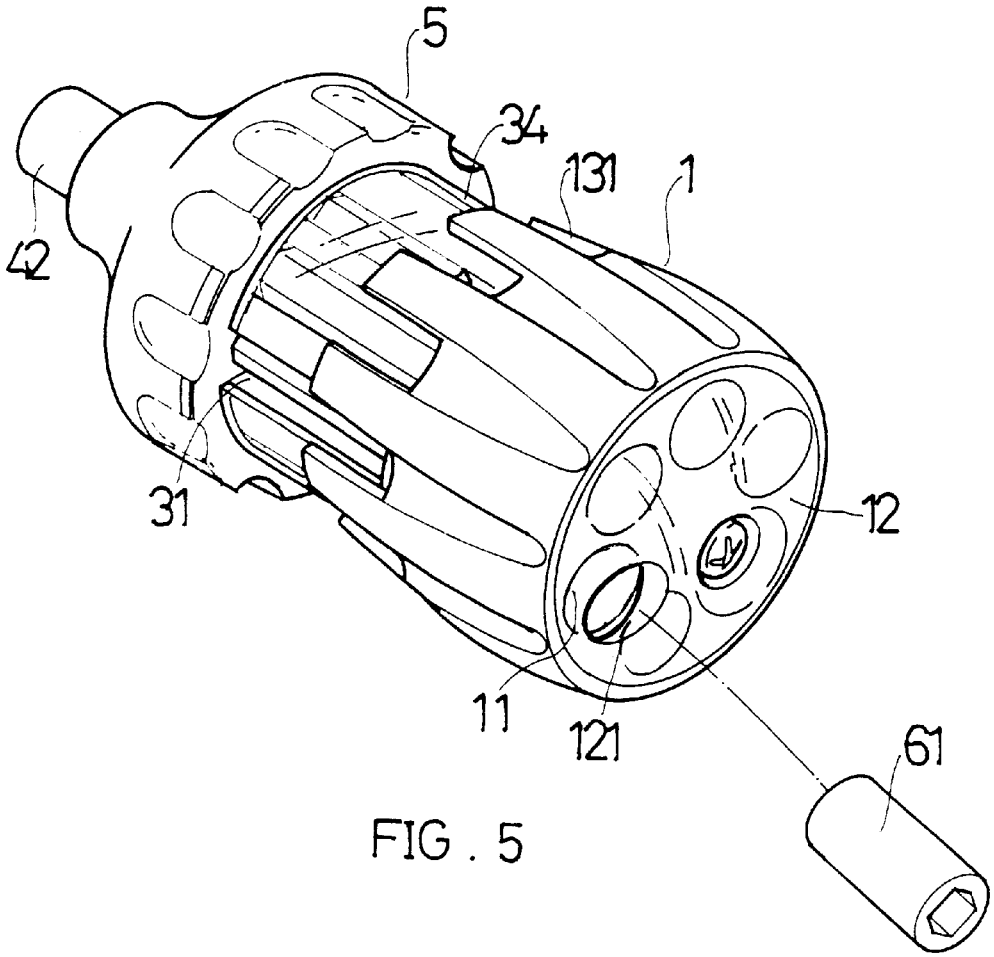
FIG. 5 shows that the sleeve is dropped out of the chamber of the grip of the present invention.
Figure 6:
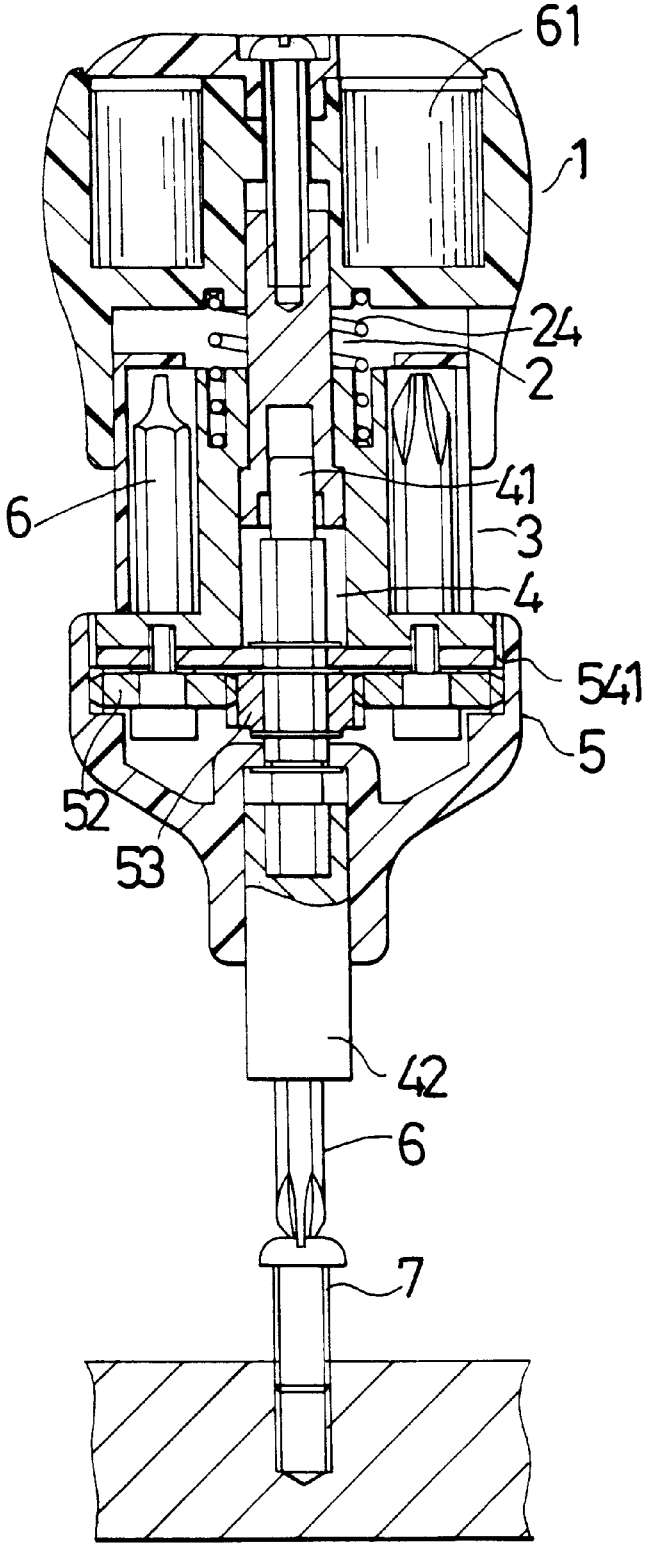
FIG. 6 is a sectional view showing that the grip is not depressed to complete the first stage of tightening operation of the screw.
Figure 7:
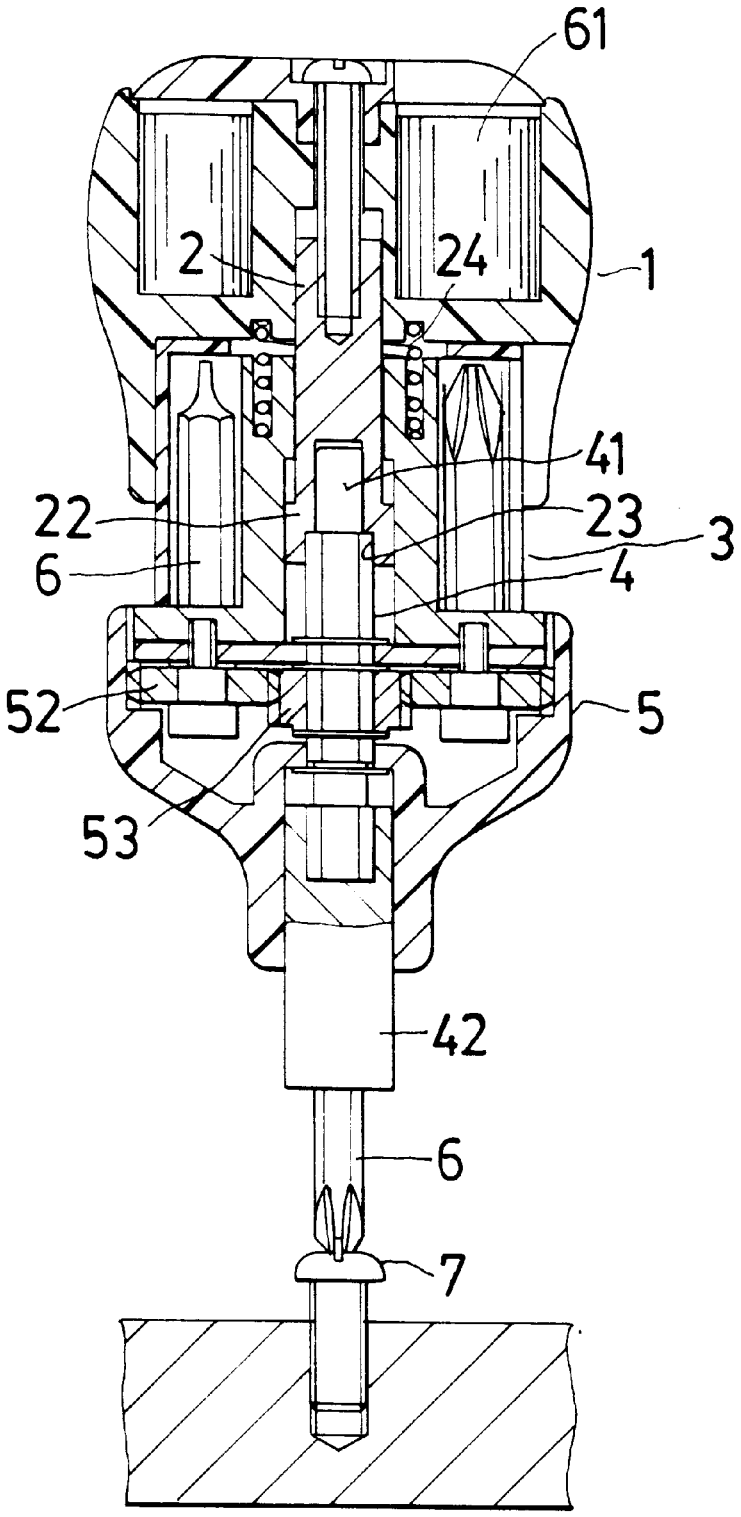
FIG. 7 is a sectional view showing that the grip is depressed to complete the second stage of tightening operation of the screw.
Figure 8:
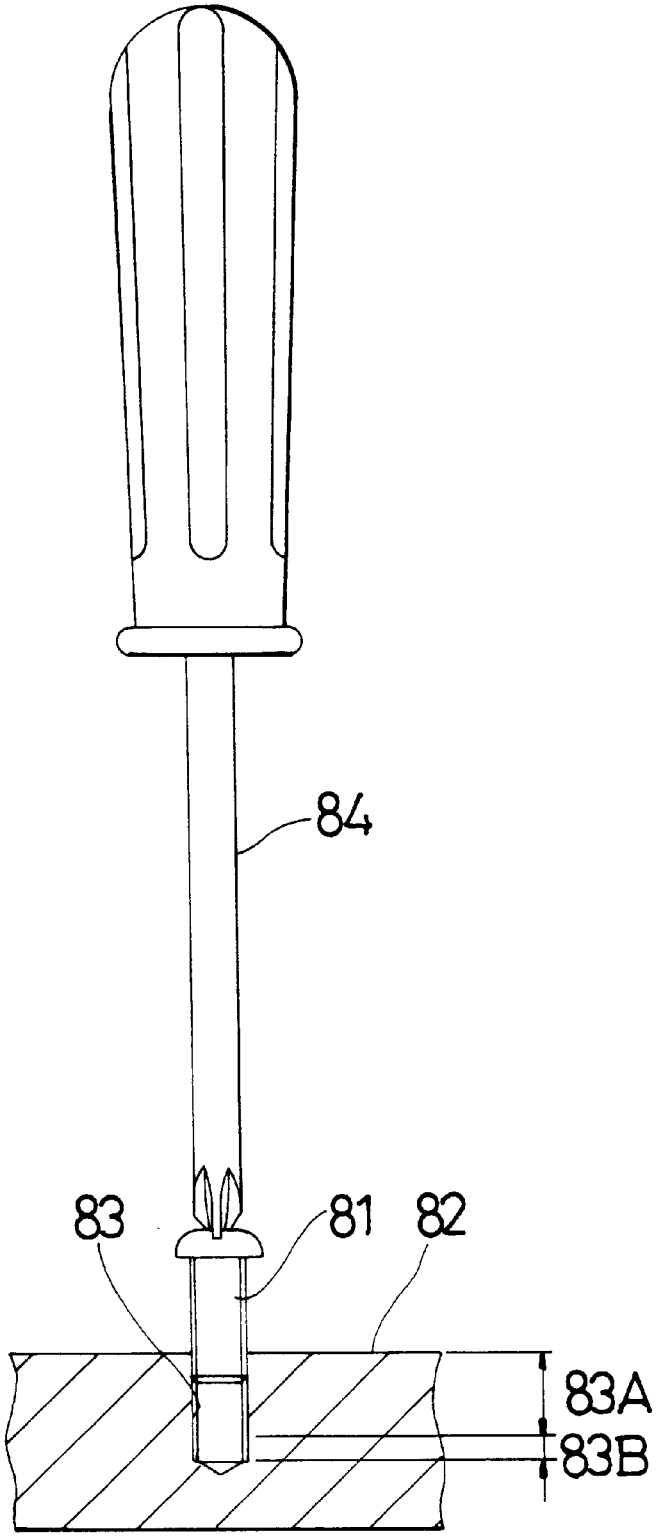
FIG. 8 PRIOR ART
FIG. 8 shows the application of a conventional screwdriver.

Referring to FIGS. 4 to 7, when using the present invention, the stopper member 34 is first rotated to align the slot 341 thereof with the receptacle 31 in which the desired screwdriver head 6 is placed. Then the screwdriver head 6 is dropped out as shown in FIG. 4. Also, as shown in FIG. 5, the cap member 12 can be rotated to align the top through hole 121 thereof with the chamber 11 in which a desired sleeve 61 is placed to drop out the sleeve 61. After taking out the screwdriver head 6, the screwdriver head 6 is fitted with the screwdriver connecting rod 42. The screwdriver head 6 is then aligned with and pressed against the screw 7 to be tightened or untightened. Then the user can hold the grip 1 with his palm and rotate the rotary wheel 5 with his fingers. The rotary wheel 5 then drives the planet gears 52 to rotate. The planet gears 52 further drive the sun gear 53 which further rotarily drives the transmission shaft 4. The ratio of tooth number of the rotary wheel 5 to that of the sun gear 53 is considerably large so that the transmission shaft 4 and the screwdriver connecting rod 42 at the bottom thereof can complete the first stage of tightening operation of the screw 7 at a quicker rotary speed as shown in FIG. 6. When the screw 7 becomes difficult to screw in, the grip 1 is depressed by the palm, making the connecting hole 23 of the connecting stem 2 engaged with the middle section of the transmission shaft 4 as shown in FIG. 7. At this time, the user can rotate the grip 1 with his fingers so as to directly rotarily drive the transmission shaft 4 by means of the grip 1. Therefore, the second stage of tightening operation of the screw 7 can be completed with greater torque. After used, the screwdriver head 6 is placed back into the receptacle 31 (the sleeve 61 is placed back into the chamber 11). Then the slot 341 of the stopper member 34 is disaligned from the receptacle 31 (the top through hole 121 is disaligned from the chamber 11) to store the screwdriver head 6 and the sleeve 61 therein without missing.

According to the above arrangement, the present invention has the following advantages:

1. In the case that it is unnecessary to depress the grip 1, the user can quickly tighten the screw 7. In the case that a great torque is necessary, the grip 1 is depressed to connect the connecting stem 2 with the transmission shaft 4 so as to obtain greater torque. Especially, when depressing the grip 1, the using state will be affected and the screwdriver can be used conveniently.

2. The sleeves 61 can be received in the chambers 11, while the screwdriver heads 6 can be received in the receptacles 31. Moreover, the transparent cap member 12 and stopper member 34 permit the user to observe the positions of the respective tools. Therefore, the user can easily quickly locate the necessary tools. Moreover, the tools are safely stored without possibility of missing.

It is to be understood that the above description and drawings are only used for illustrating one embodiment of the present invention, not intended to limit the scope thereof. Any variation and derivation from the above description and drawings should be included in the scope of the present invention.

What is claimed is:

1. A screwdriver comprising:

a grip which is a substantially cylindrical body having a top face formed with multiple annularly arranged chambers, a cap member covering the chambers, a bottom of the grip being formed with a coaxial fitting socket, the fitting socket being isolated from the chambers by a diaphragm, the grip being further formed with a coaxial through hole;

a connecting stem having a polygonal cross-section, an upper section of the connecting stem being fitted in the through hole of the grip, a bottom of the connecting stem having an enlarged end with a larger diameter, a spring being fitted around the connecting stem, a top end of the spring abutting against the diaphragm;

a receiving member which is a substantially cylindrical body having an upper section fitted in the fitting socket of the grip, a top face of the receiving member abutting against a bottom end of the spring, a periphery of the receiving member being formed with multiple axially extending receptacles, a bottom of the receiving member being formed with a flange, the receiving member being further formed with a coaxial through channel, an upper section of the through channel being small diameter polygonal hole, the enlarged end of the connecting stem being received in the through channel, a transparent cylindrical stopper member being fitted around the receiving member, one side of the stopper member being formed with an axial slot;

a transmission shaft having a substantially polygonal cross-section, an upper section of the transmission shaft being separably connected with the enlarged end of the connecting stem, a bottom end of the transmission shaft being connected with a screwdriver connecting rod; and a rotary wheel disposed at the bottom of the receiving member, having a fixing plate fixed with the receiving member, the fixing plate being formed with a coaxial through aperture smaller than the through channel of the receiving member, two opposite planet gears being fixedly disposed on bottom face of the fixing plate, inner sides of the planet gears meshing with a sun gear fixed on the transmission shaft, outer sides of the planet gears meshing with internal teeth of the rotary wheel, a bottom end of the rotary wheel sleeving the screwdriver connecting rod, the rotary wheel and the transmission shaft being restricted by each other via a latch ring.

2. A screwdriver as claimed in claim 1, wherein the cap member is transparent and has a top through hole on one side.

3. A screwdriver as claimed in claim 1, wherein a bottom face of the diaphragm is formed with an annular insertion groove coaxial with the grip, the top end of the spring being fitted in the annular insertion groove.

4. A screwdriver as claimed in claim 1, wherein a lower section of the through hole of the grip is formed as a polygonal hole communicating with the through hole.

5. A screwdriver as claimed in claim 1, wherein the top end of the connecting stem is coupled with the cap member by a screw.

6. A screwdriver as claimed in claim 1, wherein a bottom face of the enlarged end is formed with a connecting hole, an upper section of the connecting hole being a circular hole.

7. A screwdriver as claimed in claim 1, wherein the upper section of the transmission shaft is a cylindrical section for fitting into the circular hole of the connecting stem, a middle section of the transmission shaft being movably engaged in the connecting hole.

8. A screwdriver as claimed in claim 1, wherein a wall of the fitting socket is formed with multiple cut notches extending to the bottom face of the grip.

* * * * *